US010557289B2

(12) United States Patent
Wahmann et al.

(10) Patent No.: US 10,557,289 B2
(45) Date of Patent: Feb. 11, 2020

(54) LOCK FOR A MOTOR VEHICLE

(71) Applicant: Kiekert Aktiengesellschaft, Heiligenhaus (DE)

(72) Inventors: Hendrik Wahmann, Dusseldorf (DE); Carsten Fuchs, Dusseldorf (DE); Dirk Eichel, Velbert (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 748 days.

(21) Appl. No.: 14/772,133

(22) PCT Filed: Feb. 28, 2014

(86) PCT No.: PCT/DE2014/000082

§ 371 (c)(1),
(2) Date: Sep. 2, 2015

(87) PCT Pub. No.: WO2014/135142

PCT Pub. Date: Sep. 12, 2014

(65) Prior Publication Data

US 2016/0010363 A1 Jan. 14, 2016

(30) Foreign Application Priority Data

Mar. 6, 2013 (DE) ..... 10 2013 203 788
Jun. 13, 2013 (DE) ..... 10 2013 211 050

(51) Int. Cl.
*E05B 77/04* (2014.01)
*E05C 3/12* (2006.01)
(Continued)

(52) U.S. Cl.
CPC ..... *E05B 77/04* (2013.01); *E05B 77/06* (2013.01); *E05C 3/12* (2013.01); *E05C 19/02* (2013.01)

(58) Field of Classification Search
CPC ..... E05B 77/02; E05B 77/04; E05B 77/06; E05B 85/26; E05C 3/12; E05C 19/02;
(Continued)

(56) References Cited

U.S. PATENT DOCUMENTS 5,865,481 A 2/1999 Buschmann
8,757,681 B2 * 6/2014 Graute ..... E05L 381/20 292/201
(Continued)

FOREIGN PATENT DOCUMENTS

DE 19738492 A1 * 3/1998 ..... E05B 77/06
DE 19803871 A1 * 8/1999 ..... E05B 77/06
(Continued)

OTHER PUBLICATIONS

Machine Translation of EP1518983A2 by Lexis Nexis Total Patent on Sep. 23, 2015.

*Primary Examiner* — Christine M Mills
(74) *Attorney, Agent, or Firm* — Woodard, Emhardt, Henry, Reeves & Wagner, LLP

(57) ABSTRACT

The invention relates to a lock, in particular for a door or opening element of a motor vehicle. In order to avoid the unplanned opening of the lock in the event of a crash, the invention proposes a lock with a locking mechanism comprising a rotary latch, a pawl for locking the rotary latch in a detent position, preferably a blocking lever for blocking the pawl in the detent position and a release lever for opening the locking mechanism, in particular by lifting the blocking lever out of the blocking position. The lock is provided with a rotation-lock device, by means of which an opening process of the locking mechanism caused by momentum or an impact can be prevented or blocked.

18 Claims, 6 Drawing Sheets

(51) Int. Cl.
*E05C 19/02* (2006.01)
*E05B 77/06* (2014.01)

(58) Field of Classification Search
CPC ..... Y10T 292/0908; Y10T 292/1078; Y10S 292/22; Y10S 292/23; Y10S 292/65
USPC ..... 292/92, 198, DIG. 22, DIG. 23, DIG. 65
See application file for complete search history.

(56) References Cited

U.S. PATENT DOCUMENTS

| | | | |
|---|---|---|---|
| 2014/0001774 | A1 | 1/2014 | Bendel et al. |
| 2014/0035295 | A1 | 2/2014 | Bendel et al. |
| 2014/0132008 | A1 | 5/2014 | Bendel et al. |

FOREIGN PATENT DOCUMENTS

| | | | | | |
|---|---|---|---|---|---|
| DE | 102011010797 | A1 | | 8/2012 | |
| DE | 102011010815 | A1 | | 8/2012 | |
| DE | 102011010816 | A1 | | 8/2012 | |
| EP | 1241305 | A1 | * | 9/2002 | ..... E05B 77/06 |
| EP | 1518983 | A2 | | 3/2005 | |
| GB | 1203153 | A | * | 8/1970 | ..... E05B 1/0038 |

* cited by examiner

LOCK FOR A MOTOR VEHICLE

CROSS-REFERENCE TO RELATED APPLICATIONS

This application is the U.S. national stage application of International Patent Application No. PCT/DE2014/000082, filed Feb. 28, 2014, which claims priority of German Application No. 10 2013 203 788.0, filed Mar. 6, 2013 and German Application No. 10 2013 211 050.2, filed Jun. 13, 2013, which are all hereby incorporated by reference.

BACKGROUND

The invention relates to a latch for a motor vehicle with the characteristics of the generic term of claim 1.

A latch for a motor vehicle comprises a locking mechanism with a rotatably mounted catch accommodating a locking bolt, also referred to as latch holder. The locking mechanism also contains a pawl that can engage the catch in order to retain the locking bolt.

The catch of a motor vehicle latch usually contains a fork-like inlet slot (also referred to as inlet section) formed by a load arm and a collecting arm, which is entered by a locking bolt of a motor vehicle door or flap, such as a bonnet or boot lid when the door or flap is shut. The locking bolt or the latch holder then turns the catch from an opening position to a closed position until the pawl locks the catch. This position is referred to a detent position. The locking bolt can then no longer leave the inlet slot of the catch.

A latch can also contain a blocking lever that can block the pawl in its detent position. The blocking lever must be pivoted or turned out of its blocking position so that the pawl can leave its detent position for opening the locking mechanism.

Latches exist in which the catch can introduce an opening moment into the pawl, if it is in its detent position. A blocking lever is required for such a latch in order to lock the locking mechanism into place. Such latches can be opened with little force.

Motor vehicle latches exist that feature two detent positions, a pre-ratchet position and a main ratchet position. The pre-ratchet position serves to retain the door or flap if it has not reached the main ratchet position during closing. If the catch is turned further starting from the pre-ratchet position, it eventually reaches the main ratchet position.

A latch generally contains a release lever required to open a locking mechanism and to release it. Such a release lever is typically connected to the handle of a door or of a flap. Upon actuation of the handle, the release lever is actuated and pivoted in order to release the locking mechanism and thus open the latch.

In the event of a crash, the handle can be accidentally activated, causing the locking mechanism to be opened. It should be ensured that such a latch can not accidentally open in such a situation.

In order to ensure that a latch cannot accidentally open in the event of a crash, printed matter EP 1518983A2 provides a latch with a locking mechanism, containing at least one actuating lever for triggering or opening the locking mechanisms, i.e. a release lever. The latch also contains a blocking lever blocking the actuating lever in case of a specified acceleration of the vehicle.

During a crash, particularly high accelerations are generated compared to the usual opening. If the blocking lever blocks only during high vehicle accelerations, as experienced in the event of a crash, unintentional opening of the locking mechanisms in the event of a crash can be prevented. In case of a usual actuation of the door handle, the actuating lever is not blocked as no high acceleration is applied, allowing opening of the latch.

SUMMARY

The object of the invention is to improve and further develop a latch in particular in such a way that accidental opening is avoided in the event of a crash.

The task is solved by a latch according to claim 1. Advantageous further developments and designs are described in the sub claims.

The invention provides a latch, in particular for a door or a latch of a motor vehicle, containing a locking mechanism comprising a catch, a pawl for locking the catch in a detent position, preferably a blocking lever for blocking the catch in its detent position and a release lever for opening the locking mechanism, in particular, by lifting the blocking lever out of its blocking position. The latch contains a rotation-lock device able to prevent opening of the locking mechanism as a result of an impact or a momentum.

An essential part of the invention is the provision of a rotation-lock device able to prevent opening of the locking mechanism as a result of an impact or a momentum, preferably by blocking the mechanism by respective intervention. The rotation-lock device is, in particular, designed in such a way that in the event of an excessively high acceleration such as a crash acceleration and in particular of a release lever and/or of an associated handle of a door or flap, opening of the locking mechanism is prevented. Preferably, the rotation-lock device is assigned to the release lever and/or the blocking lever of the locking mechanism.

The rotation-lock device is in this case designed in such a way that the excessively high accelerations occurring, in particular, in the event of a crash and that can affect the locking mechanism in particular in form of impacts and momentums, do not cause the locking mechanism to be released, for instance, also without any contact of the release lever as a result of the mass inertia. As a result, opening of the locking mechanism caused by a crash or impact, can be prevented.

In a preferred embodiment of the invention, the rotation-lock device contains one or several blocking fingers and/or limit stops, assigned in particular to the blocking lever and/or the release lever. Generally, the blocking fingers and/or limit stops can be studs, bolts or pins or similar. In this way, the rotation-lock device can be provided on the latch in a compact manner.

In a particularly preferred embodiment, the rotation-lock device is designed in such a way that blocking of the opening process of the blocking mechanism only occurs during a movement of the blocking lever caused by an impact or a momentum. Alternatively, or in addition, the rotation-lock device does not block a regular opening and/or closing operation of the locking mechanism, in particularly, if the release lever is respectively pivoted. Correct functioning of the latch during regular use is thus ensured. The disengagement of the blocking lever for opening of the locking mechanism and the engagement of the blocking lever for blocking of the blocking lever is in this way still ensured.

Preferably, the rotation-lock device is designed to block the pivoting movement of the blocking lever and preferably in such a way that the blocking finger and/or limit stops can engage after a predetermined pivoting of the blocking lever in opening direction. The arrangement of the rotation-lock device is in this case such that one or several blocking fingers and/or limit stops only engage after a predetermined pivoting of the blocking lever in opening direction. The blocking lever can thus be blocked after a certain pivoting or an idle stroke in order to prevent an unwanted opening operation of the locking mechanism. Movement of the blocking lever caused by an impact or momentum can thus be reliably blocked, with the idle stroke ensuring a better functionality for regular opening and closing of the locking mechanism.

In order to allow a technically advantageous production, the rotation-lock device consisting of blocking fingers and or limit stops can be directly or indirectly attached to the blocking lever and/or release lever. Alternatively or in addition, blocking fingers and/or limit stops can form a single part with the blocking lever and/or release lever.

In a particularly advantageous embodiment, the blocking finger and/or limit stop provided on the blocking lever are arranged next to the contoured section. Preferably, the blocking finger and/or limit stop are then arranged on the arm of the blocking lever belonging to the blocking contour section. This ensures an improved stability and direct transmission of the force for engagement of the rotation-lock device in order to block an opening process. In particular, the arrangement is such that the blocking finger and/or limit stop are arranged before the arm of the blocking lever when looking in the opening direction of the blocking lever.

According to a further aspect of the invention, a latch with a locking mechanism is provided that contains a catch and a pawl for locking the catch. The latch preferably also contains a blocking lever, able to block the pawl if it is in its detent position. The arrangement also contains a release lever for opening or triggering the locking mechanism. If the release lever is activated, the blocking lever is moved out of its blocking position provided that the release lever is not subjected to an excessively high acceleration. In case of excessive accelerations of the release lever, caused for instance by a crash, the safety catch device of the latch prevents the release lever from being moved out of its blocking position. The latch can consequently not open if the release lever is subjected to a respectively high acceleration in the event of a crash.

In one embodiment of the invention, the safety catch device contains at least two blocking positions. If the safety catch device is in a first blocking position, for instance due to an excessive high acceleration of the release lever, caused in particular by an impact as a result of a crash and where the safety catch device is released from the first blocking position, for instance, due to a bounce back and, in particular, due to a delayed and/or repeated bounce back, the safety catch device can also prevent the locking mechanism from opening, i.e. that the release lever moves the blocking lever out of its blocking position in one embodiment, by assuming a second or further blocking position. By providing a safety catch device with at least two blocking positions, accidental opening of the latch can be prevented even in case of the occurrence of bounce back effects.

In one embodiment, the safety catch device contains an inertia lever and a blocking lever. The inertia lever and the blocking lever are connected in such a way that the inertia lever is only moved together with the blocking lever by actuating the release lever or actuating a handle of a door or flap if the release lever is accelerated in the usual manner, as experienced during a usual actuation of the door handle, i.e. it is not exposed to an excessive acceleration. In this case, the inertia lever and blocking lever are moved together in such a way that the blocking lever cannot prevent opening of the locking mechanism. Where a handle of a door or of a flap is actuated by a user of the vehicle, a handle and a release lever connected thereto are generally not excessively accelerated.

In one embodiment of the invention, the inertia lever and the blocking lever are connected to each other in such a way, that if the release lever or the handle of a door or flap are subjected to high accelerations, as is possible during a crash, only the blocking lever is moved due to the inertia of the inertia lever and into one of the blocking positions of the safety catch device, blocking further pivoting of the release lever or of the handle in such a way that opening of the locking mechanism is prevented.

In one embodiment of the invention, the safety catch device contains a spring, connecting the inertia lever and the blocking lever in such a way that the inertia lever can only be moved together with the blocking lever by actuating the release lever or by actuating the handle, when the release lever or the handle are accelerated in the usual manner. This technically simple arrangement thus prevents accidental opening of a latch in the event of a crash.

One leg of the spring is connected to the inertia lever in one embodiment of the invention. Such a connection exists, in particular, when the preferably pretensioned leg of the spring rests against the contour of the inertia lever. Another leg of the spring is connected to the blocking lever. Such a connection exists, in particular, when the preferably pretensioned leg of the spring rests against the contour of the blocking lever. In case of lower accelerations, the spring acts like a rigid connection between the blocking lever and the inertia lever. In case of lower accelerations, the blocking lever and inertia lever are thus jointly moved by actuating the release lever or handle for opening of the locking mechanism.

In case of a high acceleration, the inertia of the inertia lever deforms the spring in such a way that only the blocking lever is moved but not the inertia lever. The spring is, in particular, tensioned further in case of a high acceleration. If the blocking lever is moved independently from the inertia lever, the blocking lever then enters its blocking position. In the blocking position, the release lever or handle is prevented from being turned further which could cause an opening of the locking mechanism.

In one embodiment, the blocking lever contains a tappet that can be moved by the release lever for moving the blocking lever. Actuation of the release lever moves the tappet and thus the blocking lever.

In one embodiment, the tappet of the blocking lever, preferably extends through a slotted hole of the inertia levers in order to permit a relative movement between the blocking lever and the inertia lever.

In one embodiment, the mass of the inertia lever is several times greater than the mass of the blocking lever, in order to reliable achieve that the inertia lever is only moved during a slight acceleration of the release lever. Preferably, the mass of the inertia lever is twice, preferably three times and even more preferably even four times greater than the mass of the blocking lever.

In one embodiment, the latch contains a blocking contour, preferably rigidly connected to a latch case of the latch. The latch contour serves to block the blocking lever when the release lever and/or handle are subjected to excessive acceleration. If the blocking lever is blocked by the blocking contour and is thus in a blocking position, the release lever or handle cannot be pivoted further in such a way that the locking mechanism is opened.

In one embodiment, the blocking contour abuts against the internal wall of the latch case, in order to transfer the impact forces onto the latch case when the blocking lever rests against the blocking contour. The blocking contour can thus have a small design.

In one embodiment, the blocking lever is connected to the inertia lever in such a way that a projection of the blocking lever adjoins the external contour of the inertia lever if the acceleration of the release lever or handle is not excessively high and abuts, in particular, the section of the external contour of the inertia lever, which during pivoting of the locking mechanism, still locked in a detent position, is facing the blocked contour and/or is a maximum distance away from the axis of the inertia lever. As a result of the small distance between the blocking lever and the blocking contour when the locking mechanism is locked, the locking mechanism can be particularly quickly blocked by the safety catch device in the event of a crash and a bounce back.

In one embodiment, the blocking contour contains an arc, whose centre point corresponds to the axis of the inertia lever. Preferably, the radius of the arc is a slit wider than the maximum distance of the external contour of the inertia lever of its axis. The small distance between the blocking lever and blocking contour when the locking mechanism is locked, can cause a particularly fast blocking of the blocking mechanism by a safety catch device in case of a crash and bounce back.

In one embodiment, the blocking lever contains a projection at one end, pointing outwards in radial direction and in relation to the axis of the inertia lever. Where the blocking lever is moved in relation to the inertia lever due to an excessive acceleration of the release lever and/or handle, the projection points in the direction of the blocking contour or faces the blocking contour, ensuring that the blocking lever is held securely in a blocking position in the blocking contour. This contributes to providing a variety of blocking positions in a technically simple manner.

In one embodiment, the blocking contour contains a stop and/or at least one recess for blocking the blocking lever, if the release lever and/or handle are subjected to excessive acceleration. The recess or recesses are preferably arranged in circumferential direction of the inertia lever in counter-clockwise direction. A blocking position of the safety catch device of the blocking lever can thus be specified by the stop, the recess or recesses. Material can, in particular be saved if first a stop and then a recess is provided.

Specifying a blocking position by, for instance, a stop or a recess means that a blocking position is taken up by the safety catch device when the stop or recess can prevent accidental opening of the latch by stopping or blocking the blocking lever.

In particular in case of bounce back effects it can occur that the blocking lever is accidentally released from the blocking position on the stop of the blocking contour. The inertia lever can then move in counter-clockwise direction and cause the locking mechanism to accidentally open. A recess preferably arranged counter-clockwise in the direction of the circumference of the inertia lever allows a locking or blocking of the blocking lever again, thus preventing accidental opening of the locking mechanism also in case of bounce back effects.

In one embodiment, a recess of the blocking contour is triangular. The triangular shape of a recess results in a self-centering when the projection of the blocking lever engages in the recess and offers a particularly high reliability of the safety catch device.

In one embodiment, the blocking lever contains a triangular projection with slanting surface on both sides, with the slanting surface arranged in counter-clockwise direction, having less of an incline than the other opposing slanting surface arranged in clockwise direction around the axis of the blocking lever. The different inclines of the slanted surfaces of the projection provide a particularly reliable retention of the safety catch device or of the projection of the blocking lever in the blocking positions.

In one embodiment, one recess of the blocking contour is adapted to the projection of the blocking lever in the blocking position, determined by the recess. This adaptation is located, in particular, in the area of the overlap. Preferably, such an adaptation includes the inclines of the slanting surfaces of the projection of the blocking lever. The adaptation of the contour of the recess of the blocking contour to the contour of the projection of the blocking lever in the area of the overlap provides a particularly secure hold against pivoting on either side and prevents accidental detachment of the safety catch device and a potential damage of the locking mechanism.

In one embodiment, the stop contains an inclined surface of the blocking contour, essentially parallel to the inclination of the projection of the blocking lever in the blocking position, which can come into contact with the stop during blocking of the locking mechanism by the safety catch device. As a result of the essentially parallel inclined surfaces, the stop and the project can be reduced in size as a result of the full-area load absorption.

In one embodiment, the axis of the blocking lever is arranged at the end of the blocking levers opposing the projection. The arrangement of the axis at preferably the greatest distance to the projection provides a particularly large pivot path of the projection of the blocking lever during activation of the lever arm of the release lever and due to the thus achieved overlap of the projection in the blocking contour and a particularly reliably retention of the safety catch device in the blocking position.

In a preferred embodiment, the rotation-lock device is designed in such a way that the rotation-lock device only blocks movement of the blocking lever when the safety catch device prevents opening of the locking mechanism in case of an excessively high acceleration, in particular in the event of a crash. This ensures further that the impact or momentum experienced in particular in the event of a crash, cannot open the locking mechanism. The rotation-lock device and safety catch device are preferably functionally connected via the common release lever. The release lever can contain a respective blocking finger and/or limit stop for the rotation-lock device and can be coupled to the blocking lever and/or inertia lever of the safety catch device. Coupling of the rotation-lock device to the safety catch device thus provides a particularly safe and reliable latch.

Particularly advantageously, the rotation-lock device is designed in such a way that in the position blocked by the rotation-lock device, a sufficiently large blocking contour section of the blocking lever rests against the pawl and preferably in such a way that at least a quarter or even more preferably at least half of the blocking contour section can engage with the pawl. The result is a respectively large stop between the blocking contour section of the blocking lever and the pawl. This ensures that even in the blocked position of the rotation-lock device, a sufficient overlap of the blocking lever with the pawl can be guaranteed so that the locking mechanism is securely protected against impacts or momentums and in particular in case of accelerations experienced during a crash and prevents opening of the locking mechanism.

Preferably, the blocking finger and/or limit stop is a pin, bolt or stud or similar protruding from the blocking lever and/or release lever. Advantageously the blocking finger and/or limit stop extend essentially parallel to the axis of rotation of the blocking lever and/or of the release lever. This provides a compact and reliable rotation-lock device coming into effect by pivoting around the axis of rotation.

Below, the invention is explained in detail with reference to only one embodiment, in which:

DETAILED DESCRIPTION OF THE DRAWINGS

It is pointed out that the suggested latch can be used in all possible locking devices. A particularly advantageous embodiment is, however, used in motor vehicles.

Below, the general functioning of the latch and of the suggested safety catch device, as shown in FIGS. 1 to 4, is explained.

Figure 1:
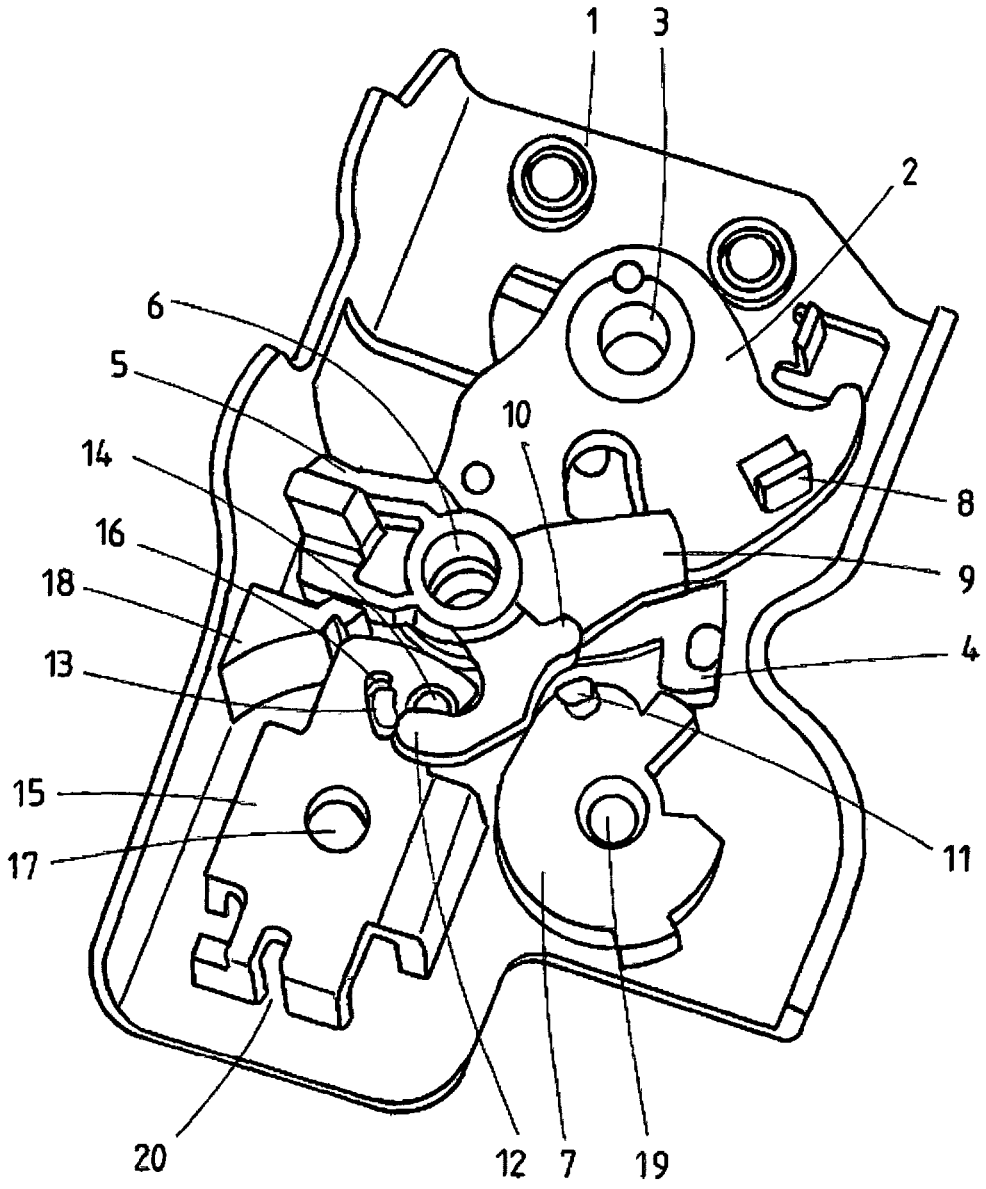
FIG. 1 shows a perspective view of the design of a latch.

FIG. 1 shows a latch case 1 of a latch made, in particular, of metal, serving to house a locking mechanism. The locking mechanism contains a rotatably mounted catch 2, preferably essentially made of metal and that can be rotated around its axis 3. The locking mechanism also contains a main ratchet pawl 4 preferably essentially made of metal and a pre-ratchet pawl 5 also preferably essentially made of metal.

The main ratchet pawl 4 and the pre-ratchet pawl 5 are arranged above each other and contain a common axis of rotation 6, allowing both pawls 4 and 5 to be pivoted independent from one another. The locking mechanism also contains a blocking lever 7 that can block the main ratchet pawl 4 in the shown locked position of the locking mechanism as shown in FIG. 1. The catch 2, the main ratchet pawl 4 and the blocking lever 7 are essentially located on the same plane. A higher plane contains the pre-ratchet pawl 5.

In order to be able to lock the catch 2 in the pre-ratchet position, the catch 2 contains a protruding pin 8 that can be moved against the lever arm 9 of the pre-ratchet pawl 5 for locking in the pre-ratchet position. The end of the lever arm 9 then prevents clockwise pivoting of the catch 2 in the direction of its open position.

The catch 2 can introduce an opening moment into the main ratchet pawl 4. When the blocking lever 7 leaves its blocking position, the main ratchet pawl 4 moves out of its detent position due to the introduced opening moment. The catch 2 can then be moved into its open position by clockwise turning around its axis 3.

The pre-ratchet pawl 5 is also the release lever of the latch. If the release lever 5 is turned in clockwise direction and is thus activated, a projection 10 of the pre-ratchet pawl 5 engages with a tappet 11 of the blocking lever 7, thus turning the blocking lever 7 out of its blocking position, if the pre-ratchet pawl 5 or the release lever 5 is not excessively accelerated.

If the release lever 5 is turned in clockwise direction for opening the locking mechanism, the end of a lever arm 12 of the release lever moves a tappet 13 of a blocking lever 21 hidden in FIG. 1 of a safety catch device. The blocking lever is rotatably connected to an inertia lever 15 by an axis 14. The blocking lever is arranged below the inertia lever 15. The tappet 13 extends through a slotted hole 16 of the inertia lever 15 and is engaged by the lever arm 12 of the release lever 5.

In case of an excessive acceleration of the release lever 5, the blocking lever 21 is pivoted around its axis 14 in clockwise direction, whilst the inertia lever 15 is not pivoted around its axis 17. This is, amongst other things, made possible as the tappet 13 of the blocking lever extends through the slotted hole 16, allowing a relative movement between the blocking lever and the inertia lever 15.

During excessive acceleration, one end of the blocking lever is moved into a blocking position provided by the blocking contour 18 rigidly connected to the latch case 1. This prevents the release lever 5 from being pivoted further in clockwise direction for pivoting the blocking lever 7 out of its blocking position. This prevents the blocking lever 7 from moving out of its blocking position for opening the locking mechanism by pivoting the blocking lever 7 around its axis 19.

The blocking contour 18 includes a stop 25 and the recesses 26 and 27, determining the blocking positions (25, 26, 27) of the safety catch device or of the blocking lever 21.

The blocking lever 21 contains a triangular projection 28 with inclined surfaces on both sides, with the inclined surface 29 arranged in clockwise direction containing less of a slope than the other facing slope of the projection arranged in clockwise direction around the axis 14.

The stop 25 is designed as a slope of the blocking contour 18 essentially arranged parallel to the slope 29 of the projection 28 of the blocking lever 21 in blocking direction. During blocking of the locking mechanism by the safety catch device, the slope 29 can come into contact with the stop 25.

The recesses 26 and 27 are triangular with the contour of the recesses (26 or 27) being adapted to the projection 28 of the blocking lever 21 in the respective position by the respective recess (26 or 27).

At its bottom end, the inertia lever 15 contains a slit 20, allowing connection to a leg 22 of a spring 23. The leg 22 of the spring 23 then extends into this slit 20.

Figure 2:
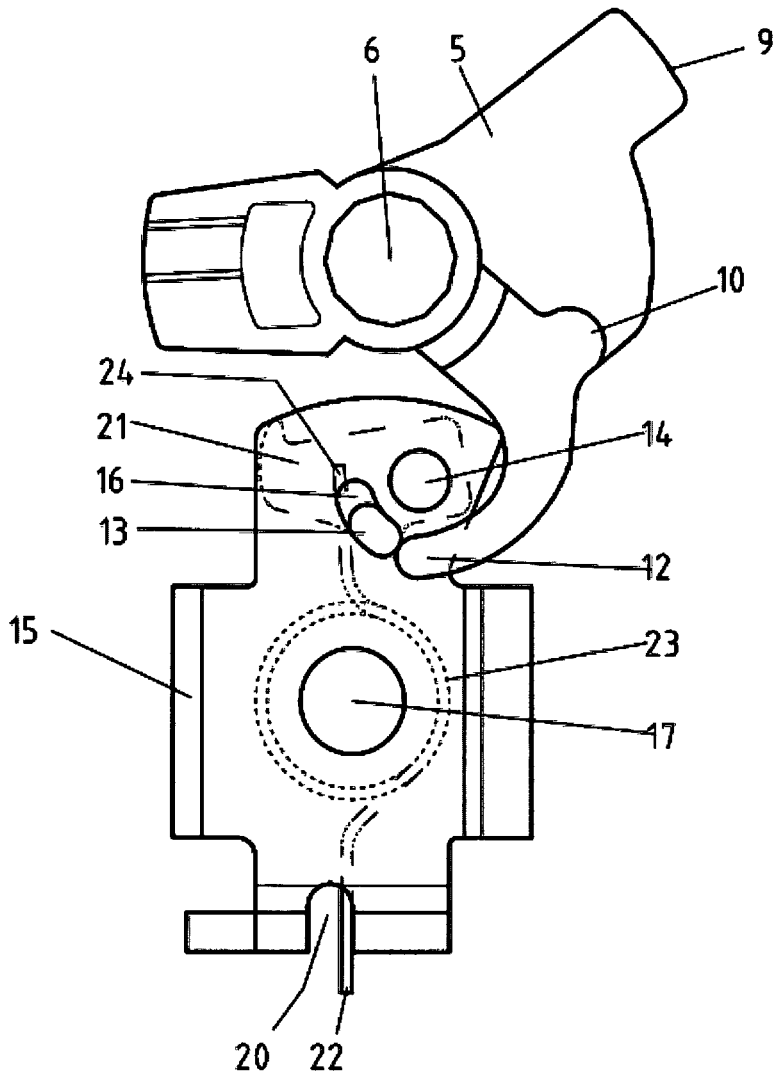
FIG. 2 shows the safety catch device in the locked state of the latch.
Figure 3:
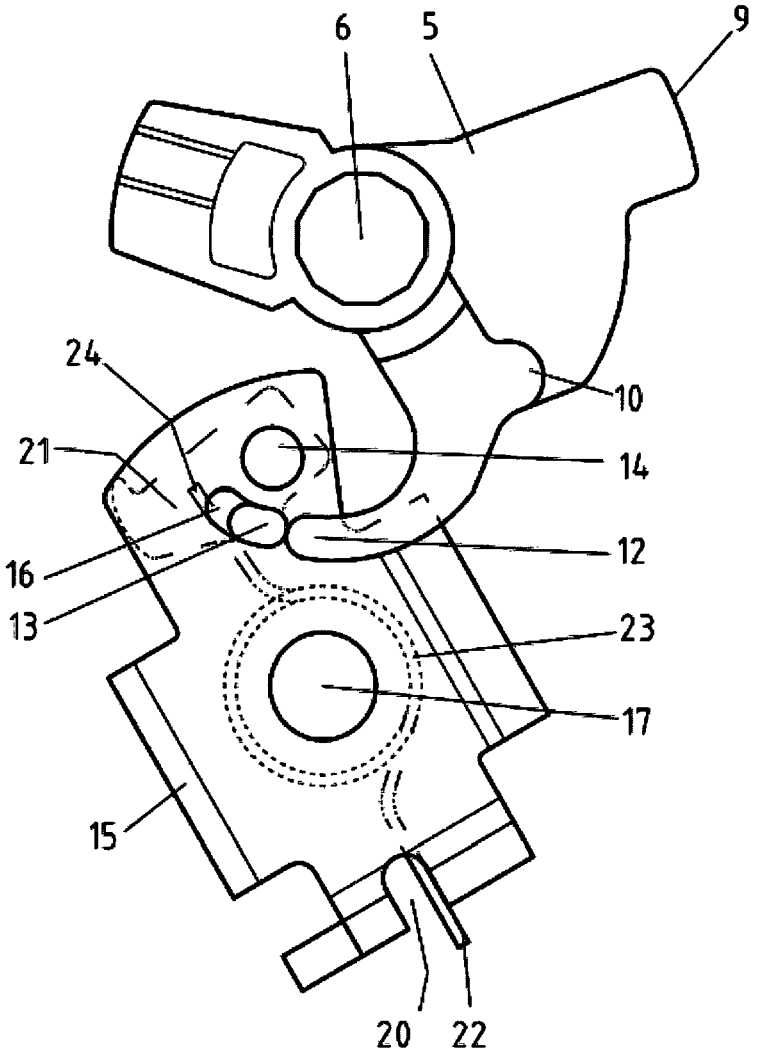
FIG. 3 shows the safety catch device in the released state of the locking mechanism.

FIGS. 2 and 3 show the design and function of the safety catch device in the event of a usual opening of the latch.

FIG. 2 shows the starting situation with the locking mechanism being locked. The blocking lever 21 is arranged below the inertia lever 15. One leg 22 of the pretensioned spring 23 is located in the recess 20 and is thus connected to the inertia lever 15. The spring 23 is also located below the inertia lever 15 and winds around the axis 17. Axis 17 contributes to holding the spring 23. The other leg 24 of the spring 23 is connected to the blocking lever 21. Preferably, the pretensioned leg 24 rests against a lateral contour, for instance against a projection of the blocking lever 21, extending downwards.

When the release lever 5 is pivoted around its axis 6 in clockwise direction for opening the locking mechanism whilst not being excessively accelerated, the spring 23 acts like a rigid connection between the blocking lever 21 and the inertia lever 15. Pivoting of the release lever 5 in clockwise direction causes the tappet 13 of the blocking lever 21 to be moved to the left. As a result, the inertia lever 15 together with the blocking lever 21 pivots around its axis 17 in counter-clockwise direction. The blocking lever 21 does in this case not assume its blocking position. The blocking lever 7 can be moved out of its blocking position by pivoting the release lever 5 in clockwise direction. The locking mechanism then opens.

Figure 4:
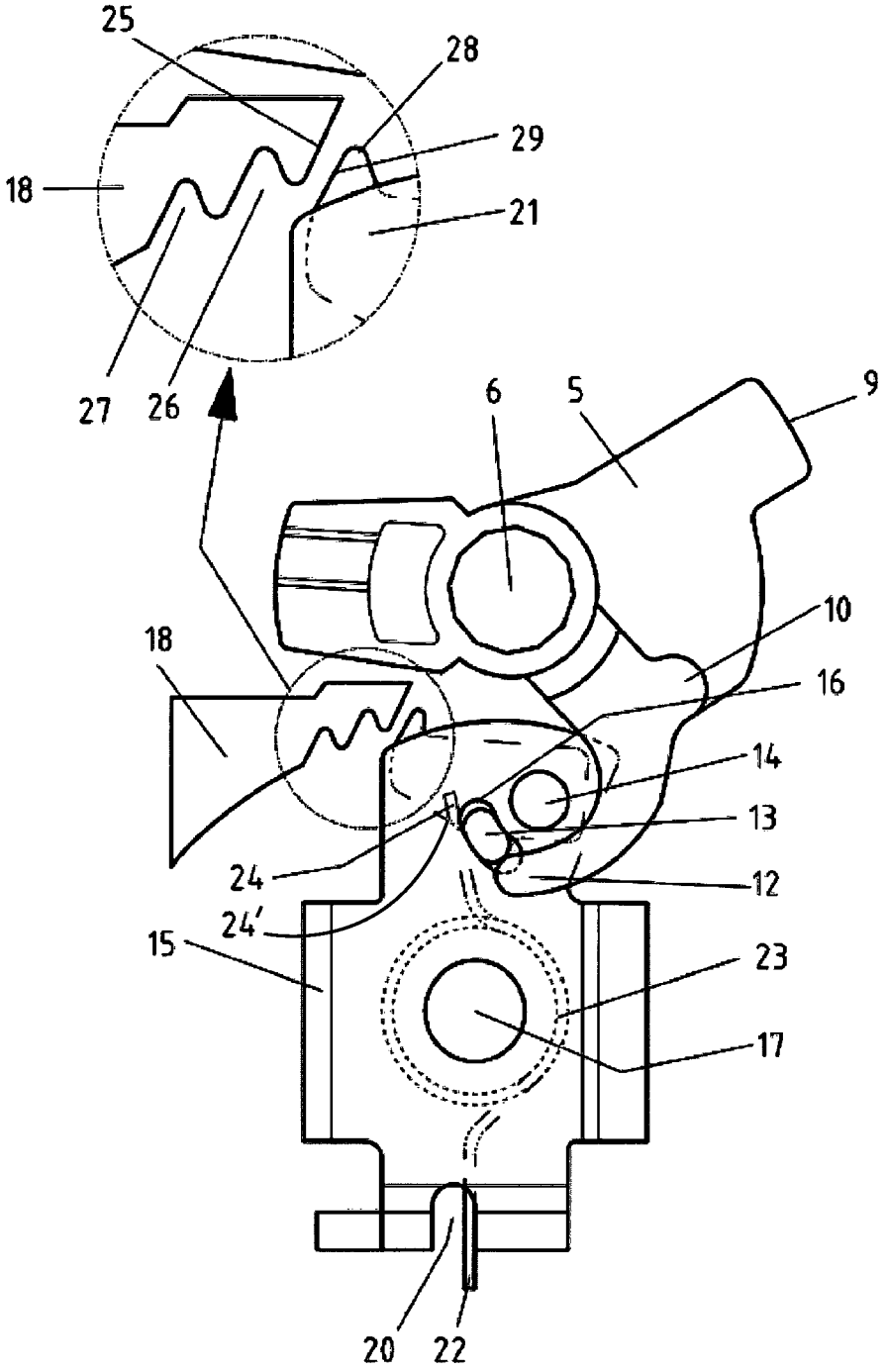
FIG. 4 shows the safety catch device in an excessively high accelerated state.

FIG. 4 shows the scenario in which the release lever 5 has been subjected to an excessively high acceleration starting from the situation shown in FIG. 2. Due to the comparatively large mass of the inertia lever 15, the inertia lever 15 is no longer pivoted around its axis 17 in counter-clockwise direction. Instead the leg 24 is deflected and moved into position 24'. The blocking lever 21 is now pivoted around its axis in clockwise direction and moved into its blocking position shown in FIG. 4.

The blocking position 25 has been reached when the end 28 of the blocking lever 21 overlaps the stop 25 so that the inertia lever 15 cannot be pivoted in counter-clockwise direction. The blocking position 25 has thus also been assumed when the end 28 of the blocking lever 21 overlaps the stop 25 but is not in contact with it, as shown in FIG. 4. The blocking contour 18 now prevents the release lever 5 from being pivoted clockwise around its axis 6 in such a way that the blocking lever 7 is moved out of its blocking position.

In the event of a bounce back it can happen that the blocking lever 21 is accidentally released from its blocking position 25 at the stop 25 of the blocking contour 18. The inertia lever 15 could then move in counter-clockwise direction, causing the release lever 5 to accidentally open the locking mechanism. The recesses 26 and 27, arranged counter-clockwise in the direction of the circumference of the inertia lever 15, now make it possible to block the inertia lever by receiving and blocking the blocking lever 21, thus preventing accidental opening of the locking mechanism.

Figure 5:
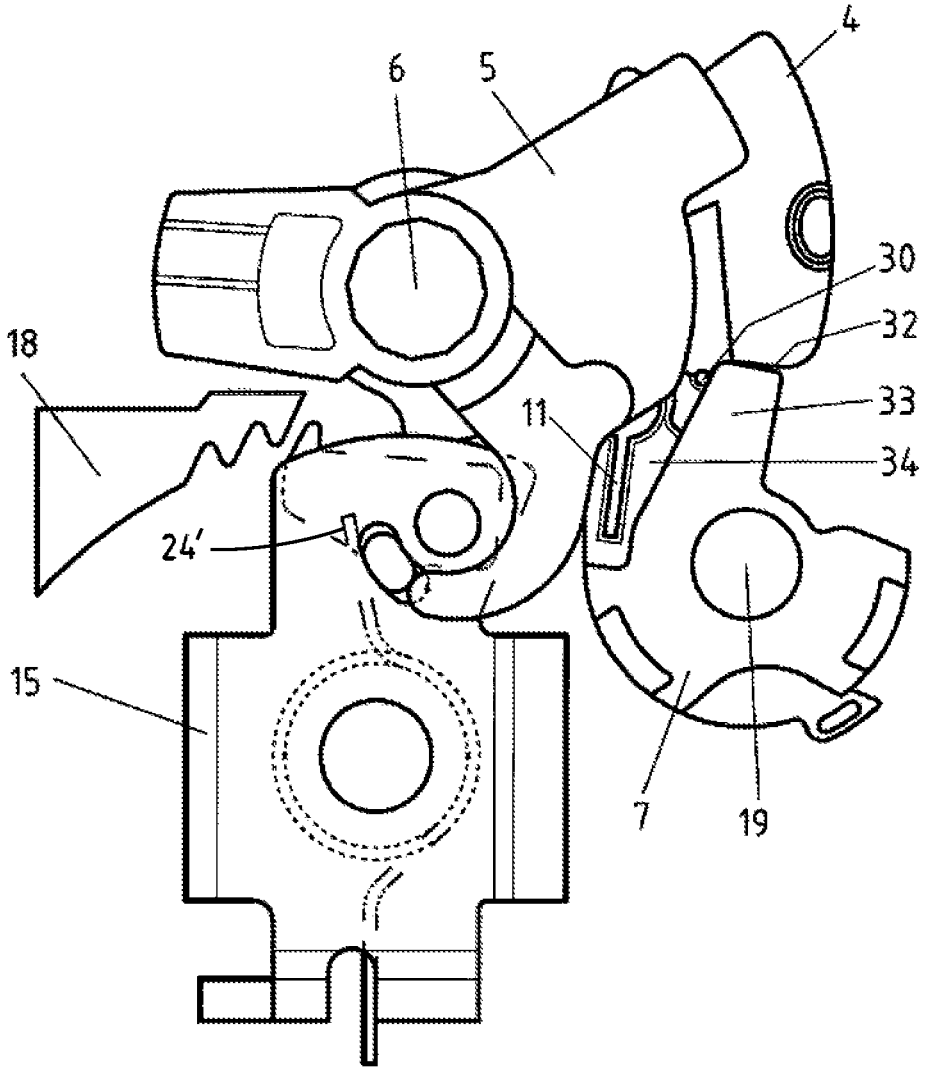
FIG. 5 shows the design of the rotation-lock device.
Figure 6:
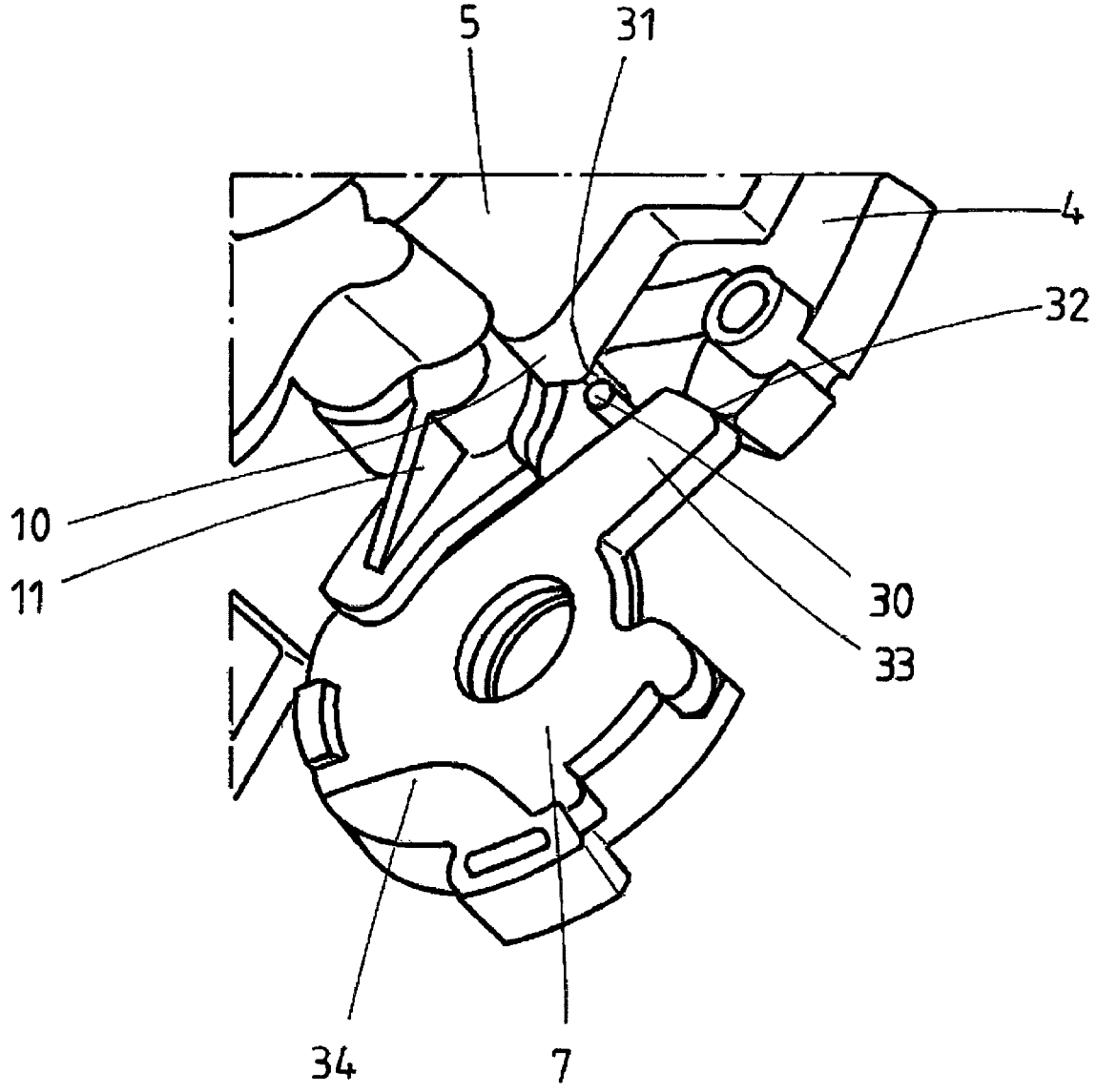
FIG. 6 shows the rotation-lock device in the blocked state.

FIG. 5 shows the rotation-lock device assigned in this case to the release lever 5 and the blocking lever 7. The rotation-lock device preferably contains a blocking finger 30 on blocking lever 7. Another blocking finger 31 on the release lever 5 is shown in FIG. 6. In principle, the rotation-lock device can also be a limit stop, depending on the design conditions. As shown in FIG. 5, the blocking finger 30 is provided on the blocking lever 7 and, in particular, next to the blocking contour section 32. Preferably, the blocking finger 30 is the arranged on the respective arm 33 of the blocking lever and extends, in case of FIG. 6, upwards above the adjacent surface of the arm 33 of the blocking lever 7. The blocking finger 31 then extends downwards viewed from the release lever 5. As a result, the blocking lever 7 and, in particular, the blocking contour section 32 can be reliably blocked by the rotation-lock device.

In the position shown in FIG. 6, the blocking finger 31 of the release lever 5 prevents the blocking lever 7 from being disengaged from its blocking position, as the blocking finger 30 of the blocking lever 7 pushes against the blocking finger 31 of the release lever 5. The two blocking fingers 30 and 31 thus form a rotation-lock device. Such blocking does not occur if the release lever 5 is in another position and, in particular, if the release lever 5 is pivoted further in clockwise direction, starting from the position shown in FIG. 6 in order to then allow the blocking lever to be moved out of its blocking position.

Preferably, the blocking lever 7 furthermore contains a cover 34. The cover 34 is, in particular, made of plastic and can be form-fitted or force-locked to the blocking lever 7, made in particular of metal. The cover 34 can, for instance, be fixed to the main body of the blocking lever 7 by means of a snap connection. Preferably, the cover 34 also comprises the blocking finger 30 of the blocking lever 7. It is, however, also possible to provide a blocking finger 30 that forms a single piece with the blocking lever 7.

FIG. 6 shows a perspective view of the rotation-lock device in the blocked state. For regular opening of the locking mechanism, the release lever 5 preferably contains a projection 10 that can engage with a tappet 11 provided on the blocking lever 7 in order to move the blocking lever 7 out of the blocking position.

FIG. 6 shows the blocked position. The operation is blocked as the blocking finger 30 on the blocking lever 7 is engaged with the other blocking finger 31 on the release lever 5. The engagement of the rotation-lock device prevents any further movement of the blocking lever 7 with the movement having, for instance, been triggered by an impact or momentum. In case of FIG. 6, the blocking fingers 30 and 31 are pins or studs that protrude from the respective plane of the blocking lever 7 or release lever 5. Accordingly, the blocking fingers 30, 31 essentially extend parallel to the axis of rotation of the blocking lever 7 or release lever 5.

Where the blocking lever 7 is moved in the opening direction by an impact or momentum, the blocking fingers 30, 31 of the rotation-lock device engage with each other, thus preventing a release of the locking mechanism. In particular, the rotation-lock device 30 is designed in such a way that the blocking fingers 30, 31 of the rotation-lock device come into contact with each other after a certain pivoting of the blocking lever 7. The rotation-lock device 30 can then be set in such a way that it becomes effective at the end of a defined idle stroke of the blocking lever 7 and that in this way, the regular functionality of the latch is not impaired during opening and closing of the locking mechanism.

The particular advantage of the suggested rotation-lock device is the fact that any movement in the locking mechanism and in particular the blocking lever 7 caused by an impact or momentum, such as a crash acceleration, is prevented. Automatic unwanted opening of the locking mechanism can thus be reliably avoided.

For regular opening of the locking mechanism, the rotation-lock device is preferably designed in such a way that in case of respective pivoting of the release lever 5, the rotation-lock device 30 is no longer effective. The blocking finger 31 on the release lever 5 is then pivoted accordingly out of the blocking area and in such a way that it can no longer engage with the blocking finger 30 on the blocking lever 7. The locking mechanism can thus be opened correctly. Basically it is, however, also possible to replace one or more blocking fingers 30, 31 with respectively designed limit stops that can also be engaged with as a rotation-lock device.

The rotation-lock device 30 is also designed in such a way that the blocking lever 7 can engage in the blocking position in order to retain the pawl 4. The blocking contour section 32 can then serve as a stop for the pawl 4 and cause locking of the pawl 4 and thus locking of the catch 2. Accordingly, the rotation-lock device 30 particularly with the arrangement of the blocking fingers 30, 31 is designed in such a way that the blocking lever 7 can be pivoted into the blocking position for locking the locking mechanism without any blocking engagement of the rotation-lock device.

The rotation-lock device is preferably only effective in the area in which the safety catch device blocks the release lever 5 by a blocking position 25, 26, 27 in particular with the inertia leaver 15. For this purpose, the rotation-lock device preferably contains a blocking finger 30 or limit stop, located on the release lever 5. This ensures that the functionality of the rotation-lock device is coupled to the explained safety catch device so that opening of the locking mechanism in case of excessive acceleration can be better prevented, in particular in the event of a crash. The safety catch device preferably corresponds to the safety catch device explained above with reference to FIGS. 1 to 4 so that full reference can be made to the above descriptions.

FIG. 6 also shows that the rotation-lock device is particularly advantageously designed in such a way that in the position blocked by the rotation-lock device, an adequately large blocking contour section 32 of the blocking lever 7 rests against the pawl 4. Preferably, the part of the blocking contour section 32 that can engage with the pawl 4 amounts to at least a quarter and preferably half of the contour section 32. This ensures adequate overlapping of the engaging elements so that the locking mechanism as a whole is better protected against momentums or impacts, in particular in the event of a crash.

The rotation-lock device can be conveniently provided with the explained blocking device as part of a latch.

All of the above explanations relating to the safety catch devices thus apply, in respect of the suggested rotation-lock device and such a latch design for use in a motor vehicle.

Given the problems experienced in the event of a crash, it is clear that the latch with a safety catch device and rotation-lock device is particularly significant. Any opening of the locking mechanism caused by impact or momentum can even under excessive acceleration such as accelerations in case of a crash be reliably prevented by the safety catch device and the rotation-lock device being part of the latch whilst also offering a compact design.

The invention claimed is:

1. A latch for a door of a motor vehicle comprising a locking mechanism, the locking mechanism comprising:

a catch that is rotatable between an open position and a closed position, a pawl that is rotatable between a locked position that holds the catch in the closed position and an unlocked position where the pawl does not prevent the catch from rotating to the open position, a first blocking lever that is rotatable between a blocked position that holds the pawl in the locked position and an unblocked position where the first blocking lever does not block the pawl from moving to the unlocked position, a release lever adapted to move the first blocking lever from the blocked position to the unblocked position, a blocking contour that defines a recess, and a rotation-lock device that comprises a projection that is operatively coupled to the release lever or the blocking lever, wherein, in the event of a motor vehicle crash, the projection is adapted to engage the recess on the blocking contour thereby preventing the release lever from moving the blocking lever to the unblocked position or preventing the blocking lever from moving to the unblocked position, wherein the rotation-lock device further comprises a second blocking lever, wherein the projection is on the second blocking lever, and wherein the rotation-lock device further comprises an inertia lever, wherein the second blocking lever is rotationally connected to the inertia lever.

2. The latch according to claim 1, wherein the rotation-lock device further comprises a spring that biases the second blocking lever relative to the inertia lever.

3. The latch according to claim 2, wherein, during normal operation where the latch is not subjected to excessive acceleration such as during a crash, the spring acts as a rigid connection between the second blocking lever and the inertia lever so that the projection does not engage the recess.

4. The latch according to claim 2, wherein, when subjected to excessive acceleration such as during a crash, the inertia lever and the second blocking lever rotate relative to each other against the biasing force of the spring so that the projection engages the recess and prevents the release lever from moving the blocking lever to the unblocking position or prevents the blocking lever from moving to the unblocking position.

5. The latch according to claim 4, wherein the second blocking lever further comprises a tappet that extends through a slotted hole defined in the inertia lever, wherein the slotted hole limits rotation of the second blocking lever relative to the inertia lever.

6. The latch according to claim 5, wherein the release lever can engage the tappet on the second blocking lever when the projection engages the recess.

7. The latch according to claim 2, wherein the second blocking lever further comprises a tappet that extends through a slotted hole defined in the inertia lever, wherein the slotted hole limits rotation of the second blocking lever relative to the inertia lever.

8. The latch according to claim 2, wherein the projection that is operatively coupled to the release lever.

9. The latch according to claim 8, wherein, when subjected to excessive acceleration such as during a crash, the inertia lever and the second blocking lever rotate relative to each other against the biasing force of the spring so that the projection engages the recess and prevents the release lever from moving the blocking lever to the unblocking position.

10. The latch according to claim 9, wherein the second blocking lever further comprises a tappet that extends through a slotted hole defined in the inertia lever, wherein the slotted hole limits rotation of the second blocking lever relative to the inertia lever.

11. The latch according to claim 1, wherein the release lever and the pawl rotate about a common axis.

12. The latch according to claim 1, wherein the blocking contour is rigidly connected to a latch case.

13. The latch according to claim 1, wherein the catch is biased to rotate toward the open position.

14. The latch according to claim 13, wherein the catch can move the pawl from the locked position to the unlocked position.

15. The latch according to claim 1, wherein the recess is triangular and adapted to the projection.

16. The latch according to claim 1, wherein the blocking contour defines a first inclined surface.

17. The latch according to claim 16, wherein the projection defines a second inclined surface that is essentially arranged parallel to the first inclined surface.

18. The latch according to claim 1, wherein the projection that is operatively coupled to the release lever.

* * * * *